US010265588B2

(12) United States Patent
Aramaki

(10) Patent No.: US 10,265,588 B2
(45) Date of Patent: Apr. 23, 2019

(54) GOLF CLUB SET WITH STEPPED CROWN LENGTH PROGRESSION

(71) Applicant: DUNLOP SPORTS CO. LTD., Kobe-shi, Hyogo (JP)

(72) Inventor: Tomotaka Aramaki, Kobe (JP)

(73) Assignee: SUMITOMO RUBBER INDUSTRIES, LTD., Kobe-Shi, Hyogo (JP)

( * ) Notice: Subject to any disclaimer, the term of this patent is extended or adjusted under 35 U.S.C. 154(b) by 302 days.

(21) Appl. No.: 15/171,465

(22) Filed: Jun. 2, 2016

(65) Prior Publication Data

US 2016/0354653 A1 Dec. 8, 2016

(30) Foreign Application Priority Data

Jun. 3, 2015 (JP) ..... 2015-113533

(51) Int. Cl.
*A63B 53/04* (2015.01)
*A63B 53/00* (2015.01)

(52) U.S. Cl.
CPC .... *A63B 53/0466* (2013.01); *A63B 2053/005* (2013.01); *A63B 2053/0416* (2013.01)

(58) Field of Classification Search
CPC ..... A63B 2053/005; A63B 2053/0437
USPC ..... 473/287, 290, 291
See application file for complete search history.

(56) References Cited

U.S. PATENT DOCUMENTS 5,221,086 A * 6/1993 Antonious ..... A63B 53/04 473/327
5,547,426 A * 8/1996 Wood ..... A63B 53/04 473/290
7,758,440 B2 * 7/2010 Llewellyn ..... A63B 53/0466 473/244
7,803,062 B2 * 9/2010 Gilbert ..... A63B 53/047 473/290
8,083,609 B2 * 12/2011 Burnett ..... A63B 53/0466 473/327
8,986,131 B2 * 3/2015 Stites ..... A63B 53/0466 473/327

(Continued)

FOREIGN PATENT DOCUMENTS

JP 2015-29628 A 2/2015

OTHER PUBLICATIONS

Japanese Notification of Reasons for Rejection and English translation for Application No. 2015-113533, dated Sep. 18, 2018.

*Primary Examiner* — William M Pierce
(74) *Attorney, Agent, or Firm* — Birch, Stewart, Kolasch & Birch LLP

(57) ABSTRACT

The golf club set according to the present invention is a golf club set constituted by a plurality of numbered golf clubs with different loft angles. In each of the golf, a crown portion has a main body portion that connects to the sole portion and a raised portion that rises to form a step from the main body portion and extends in a toe-heel direction along a boundary with the face portion. In at least one pair of a lower numbered golf club and a higher numbered golf club, among the plurality of golf clubs included in the golf club set, a length of the step in a face-back direction along a perpendicular plane that passes through a sweet spot and a center of gravity of the golf club head is longer in the lower numbered golf club than in the higher numbered golf club.

10 Claims, 7 Drawing Sheets

(56) References Cited

U.S. PATENT DOCUMENTS

| | | | | |
|---|---|---|---|---|
| 9,011,266 | B2 * | 4/2015 | Brunski | A63B 53/0466 473/329 |
| 9,144,721 | B2 * | 9/2015 | Golden | A63B 60/00 |
| 9,498,688 | B2 * | 11/2016 | Galvan | A63B 60/00 |
| 9,700,765 | B2 * | 7/2017 | Frame | A63B 53/0466 |
| 9,839,819 | B2 * | 12/2017 | Mizutani | A63B 60/52 |
| 2006/0079349 | A1 * | 4/2006 | Rae | A63B 53/0466 473/345 |
| 2008/0051210 | A1 * | 2/2008 | Park | A63B 53/047 473/291 |
| 2010/0210373 | A1 | 8/2010 | Park et al. | |
| 2012/0149494 | A1 * | 6/2012 | Takahashi | A63B 53/0466 473/345 |
| 2013/0324293 | A1 * | 12/2013 | Stites | A63B 53/0466 473/327 |
| 2013/0324295 | A1 * | 12/2013 | Oldknow | A63B 53/0466 473/327 |
| 2014/0274448 | A1 * | 9/2014 | Willett | A63B 53/04 473/327 |

* cited by examiner

Cross-section E1

GOLF CLUB SET WITH STEPPED CROWN LENGTH PROGRESSION

CROSS REFERENCE TO RELATED APPLICATION

This application claims a priority to Japanese Patent Application No. 2015-113533 filed on Jun. 3, 2015, which is hereby incorporated by reference in its entirety.

FIELD OF INVENTION

The present invention relates to a golf club set.

BACKGROUND OF THE INVENTION

JP2015-29628A discloses a golf club head in which a raised portion is formed on a crown portion and the raised portion is extending along a boundary between a crown portion and a face portion. In this golf club, due to the raised portion, the height of the face portion is increased thus improving restitution performance, and the height of the region of the crown portion other than the raised portion is reduced, thus lowering the center of gravity of the head.

In the case where a golf club set is configured using golf clubs having a golf club head such as described above in which all raised portions are designed with roughly the same dimensions, when taking the address position there is a possibility that the raised portion looks different depending on the club, leaving the golfer with a sense that something is not right. In particular, there is the problem that the position of the head of lower numbered clubs is forward at address compared to higher numbered clubs, and therefore the step of the raised portion tends to stand out, making it more difficult to take the address position when using lower numbered clubs than when using higher numbered clubs.

The present invention was made in order to resolve this problem, and an object thereof is to provide a golf club set that can prevent the perception of the raised portion causing a sense that something is not right between different numbered clubs, and that allows the address position to be taken naturally even when the club is switched to the different numbered club.

SUMMARY OF INVENTION

The present invention is a golf club set including a plurality of numbered golf clubs with different loft angles, the golf clubs each having a shaft and a golf club head, the golf club head having a crown portion, a face portion, and a sole portion. The crown portion has a main body portion that connects to the sole portion and a raised portion that extends in a toe-heel direction along a boundary with the face portion and rises to form a step from the main body portion, and in at least one pair of a lower numbered golf club and a higher numbered golf club, among the plurality of golf clubs included in the golf club set, a length of the step in a face-back direction along a perpendicular plane that passes through a sweet spot and a center of gravity of a golf club head is longer in the lower numbered golf club than in the higher numbered golf club.

In the above golf club set, the at least one pair of the lower numbered golf club and the higher numbered golf club can be adjacently numbered golf clubs.

In the above golf club set, the length of the raised portion in the face-back direction along the perpendicular plane that passes through the sweet spot and the center of gravity of the golf club head can be configured to be the same for the lower numbered golf club and the higher numbered golf club.

At least one of the golf clubs included in the above golf club set can be configured by assembling a head body and a face member, the head body can be constituted by the crown portion and the sole portion and can have an opening formed therein that is surrounded by the crown portion and the sole portion, the face member can be formed in a cup shape having the plate-shaped face portion for hitting the ball and a peripheral portion that extends from a peripheral edge of the face portion and is joined to an end surface of the opening, and the peripheral portion of the face member can be joined to the crown portion and the sole portion at the opening of the head body.

The golf club set according to an one aspect of embodiment prevents a sense that is something is not right in the perception of the raised portion between different numbered clubs and allows the address position to be taken naturally even when the club is switched to the different numbered club.

DETAILED DESCRIPTION OF THE PREFERRED EMBODIMENTS

First Embodiment

An embodiment of a golf club set according to the present invention is described below with reference to the drawings. The golf clubs that constitute the golf club set according to the present embodiment are utility-type golf clubs (e.g., No. 2 to No. 7 utility golf clubs), and, as will be described below, apart from the loft angles, mainly the shape of the raised portion of the crown portion is different. First, one golf club will be used as an example below, and after the common structure has been described, the shape of the crown portion for each club number in the golf club set will be described in detail.

1. Overview of Golf Club Head

Figure 1:
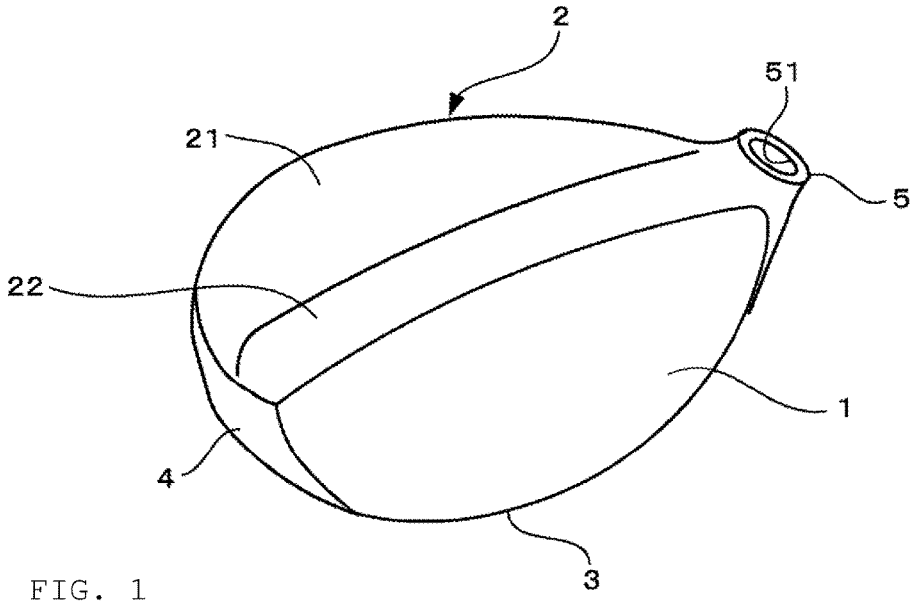
FIG. 1 is a perspective view of a reference state of a golf club head according to an embodiment.

As shown in FIG. 1, the golf club head of the present embodiment (hereinafter, may be referred to as simply the "head") has a hollow structure, and wall surfaces thereof are formed by a face portion 1, a crown portion 2, a sole portion 3, a side portion 4, and a hosel portion 5.

The face portion 1 is the surface that hits the ball, and the crown portion 2 is adjacent to the face portion 1 and constitutes the upper surface of the head. The sole portion 3 constitutes the bottom surface of the head, and is adjacent to the face portion 1 and the side portion 4. Also, the side portion 4 is the region between the crown portion 2 and the sole portion 3, and extends from the toe side of the face portion 1 to the heel side of the face portion 1 across the back side of the head. Furthermore, the hosel portion 5 is the region provided adjacent to the heel side of the crown portion 2, and has an insertion hole 51 for insertion of the shaft (not shown) of the golf club. A central axis Z of the insertion hole 51 coincides with the axis of the shaft.

Figure 2:
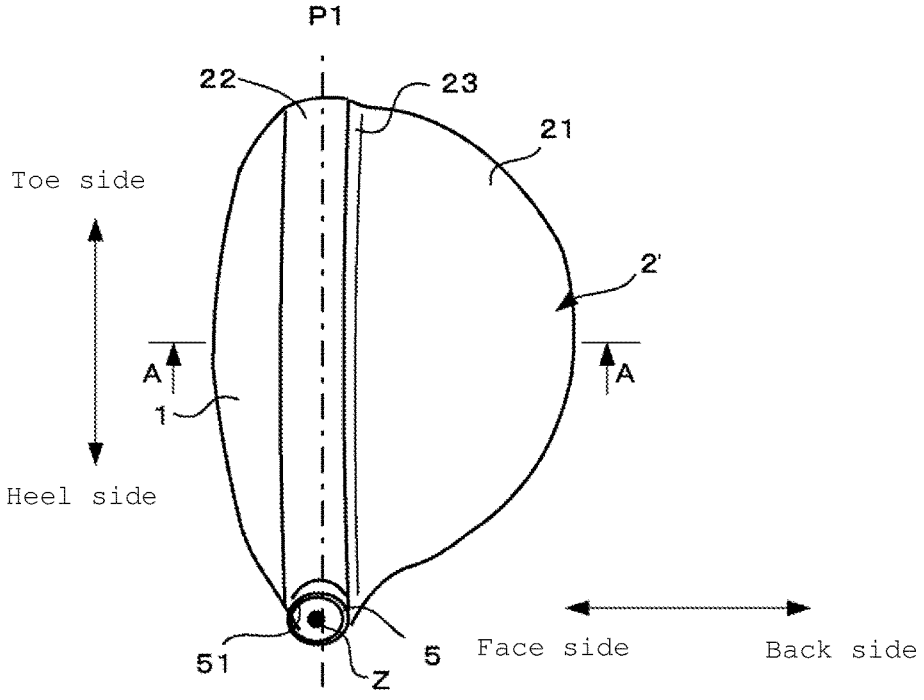
FIG. 2 is a plan view of FIG. 1.

The following describes the aforementioned reference state. First, as shown in FIG. 2, a state in which the central axis Z is in a plane P1 that is perpendicular to a horizontal plane H (placement surface; see FIG. 5) and the head is placed on the horizontal plane H at a predetermined lie angle and real loft angle is prescribed as the reference state. The plane P1 will be referred to as a reference perpendicular plane P1. Also, as shown in FIG. 2, the direction of the line of intersection of the reference perpendicular plane P1 and the horizontal plane H will be referred to as the toe-heel direction, and the direction that is perpendicular to the toe-heel direction and parallel to the horizontal plane H will be referred to as the face-back direction.

Figure 3A:
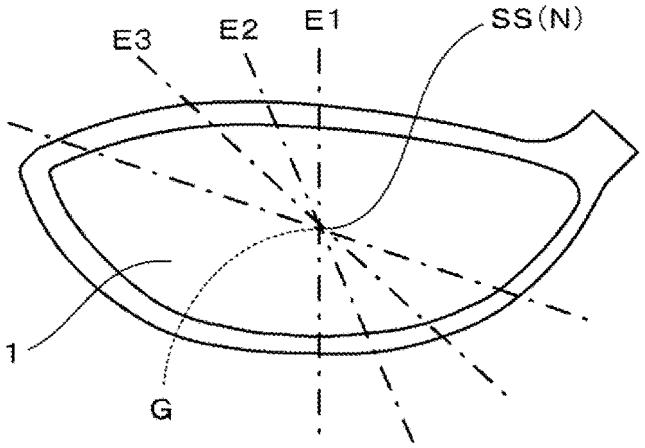
FIG. 3A and FIG. 3B are diagrams illustrating a boundary of a face portion.
Figure 3B:
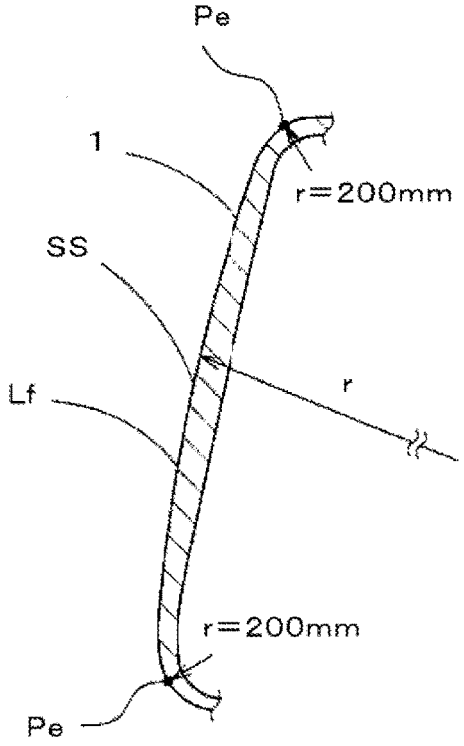

In the present embodiment, the boundary between the crown portion 2 and the side portion 4 can be defined as follows. Specifically, if a ridge line is formed between the crown portion 2 and the side portion 4, that ridge line serves as the boundary. In contrast, if a clear ridge line is not formed, the boundary is the outline that is seen when the head is placed in the reference state and viewed from directly above the center of gravity of the head. Similarly, in the case of the boundary between the crown portion 2 and the face portion 1, if a ridge line is formed, that ridge line serves as the boundary. However, if a clear ridge line is not formed, the peripheral edge (boundary) of the face portion 1 is defined by positions Pe where, in cross-sections E1, E2, E3 and so on that include a straight line N connecting the center of gravity G of the head and a sweet spot SS as shown in FIG. 3A, for example, a radius of curvature r of an outline Lf of the outer surface of the face first reaches 200 mm when moving outward from the sweet spot side, as shown in FIG. 3B. Note that the sweet spot SS is the intersection between the face surface and a normal line (straight line N) of the face surface that passes through the center of gravity G of the head.

Also, in the present embodiment, the boundary between the sole portion 3 and the face portion 1 and between the sole portion 3 and the side portion 4 can be defined as follows. Specifically, if a ridge line is formed between the sole portion 3 and the face portion 1 and between the sole portion 3 and the side portion 4, that ridge line serves as the boundary. Also, although the golf club head according to the present embodiment has the side portion 4, in cases such as where, for example, the side portion 4 is not provided, the side portion 4 cannot be clearly distinguished and is included in the sole portion 3, or the sole portion 3 is directly connected to the crown portion 2, the ridge line between the sole portion 3 and the crown portion 2 serves as the boundary between both portions. Also, if a clear ridge line is not formed, the boundary is the outline that is seen when the head is placed in the reference state and viewed from directly above the center of gravity of the head. Note that, in consideration also of the case where the side portion cannot be clearly distinguished as described above, the "sole portion" according to the present invention is deemed to include the side portion.

The volume of this golf club head is, for example, preferably 90 $cm^3$ or more, and more preferably 100 $cm^3$ or more. A head having such a volume serves to make the golfer feel more confident when the club is held at address, and also to increase the sweet spot area and the moment of inertia. Note that although an upper limit of the head volume is not particularly defined, in terms of practical use, it is, for example, desirably 130 $cm^3$ or less for a utility wood.

Also, the head can be formed from, for example, maraging steel having a specific gravity of approximately 7.7 to 7.8. Besides maraging steel, the head can be formed from one or a plurality of materials selected from among stainless steel, titanium alloy, an aluminum alloy, a magnesium alloy, an amorphous alloy, and the like.

2. Assembly Structure of Golf Club Head

Figure 4:
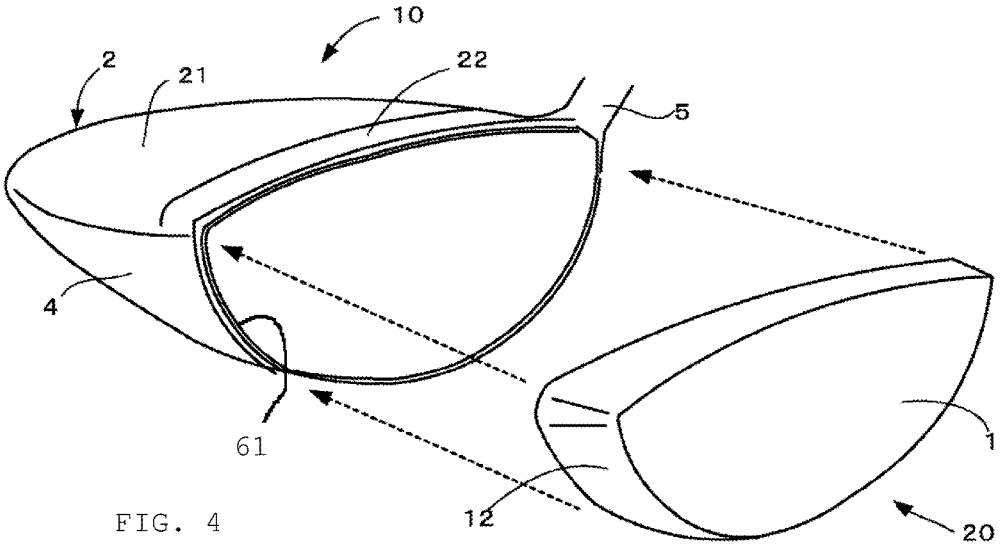
FIG. 4 is a perspective view illustrating assembly of the golf club head shown in FIG. 1.

As shown in FIG. 4, the head according to the present embodiment is configured by assembling a head body 10 and a face member 20. The head body 10 has the crown portion 2, the sole portion 3 and the side portion 4, and the face member 20 is formed in a cup shape that has the face portion 1 and a peripheral portion 12 extending from the periphery of the face portion 1. This head body 10 has an opening that is surrounded by the crown portion 2, the sole portion 3 and the side portion 4, and the face member 20 is attached so as to block the opening. Specifically, the end surface of the peripheral portion 12 of the face member 20 is abutted against the end surface of an opening 61, and these two portions are joined by welding as described below. The face member 20, by being attached to the opening of the head body 10, is integrated with the head body 10, and the peripheral portion 12 of the face member 20 thereby functions as a portion of the crown portion 2, the sole portion 3, and the side portion 4. Accordingly, the integral surfaces formed by attachment of the peripheral portion 12 of the face member 20 to the head body 10 constitute the crown portion 2, the sole portion 3, and the side portion 4. For this reason, strictly speaking, the various portions of the head body 10 are apart of these integral surfaces, but the portions of the head body 10 may be referred to below as the crown portion 2, the sole portion 3, and the side portion 4 without making this distinction.

3. Structure of Crown Portion and Sole Portion

Figure 5:
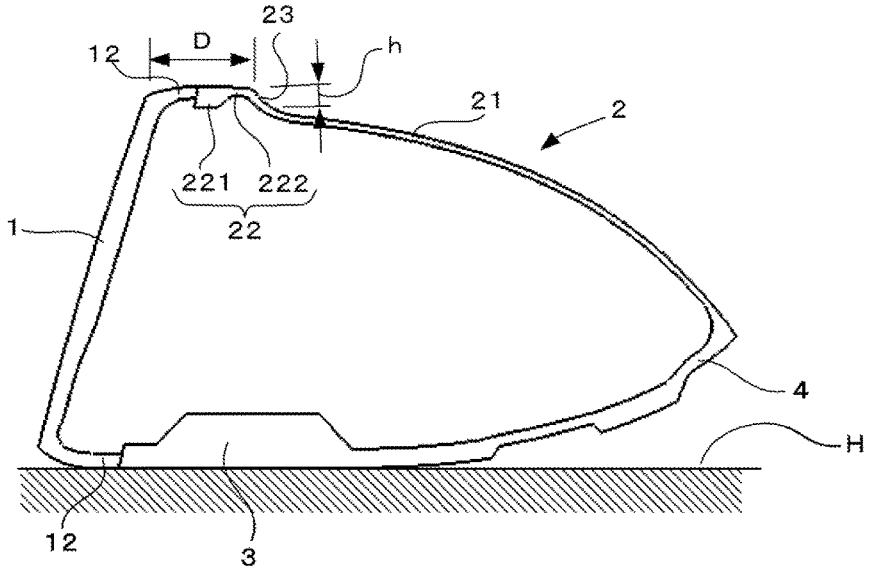
FIG. 5 is a cross-sectional diagram taken along a line A-A in FIG. 2.
Figure 6A:
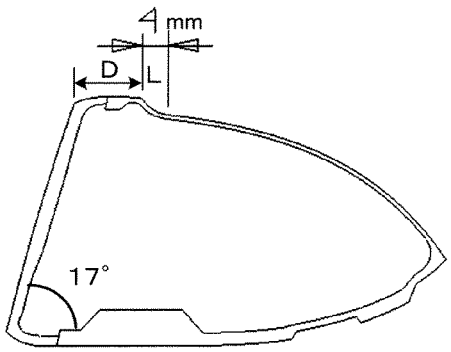
FIG. 6A to 6F are cross-sectional views of golf club heads that constitute a golf club set according to an embodiment.
Figure 6B:
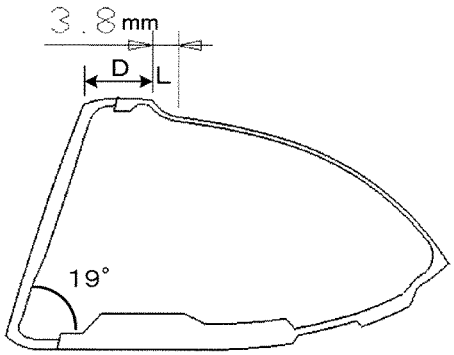
Figure 6C:
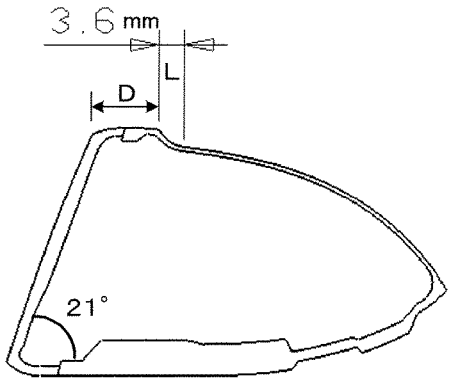
Figure 6D:
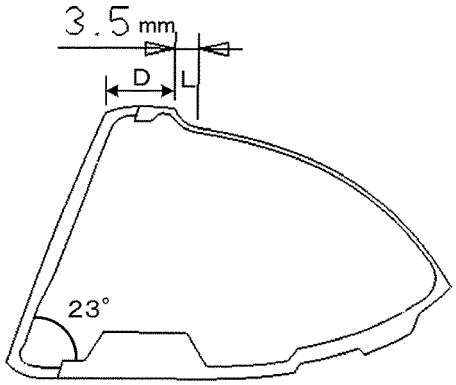
Figure 6E:
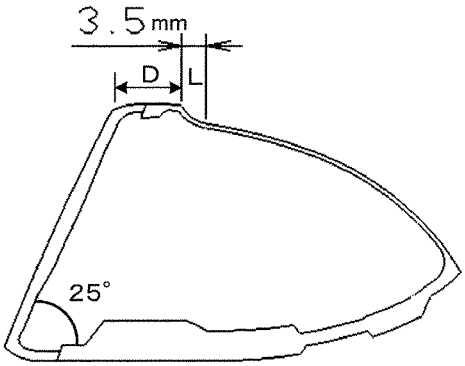
Figure 6F:
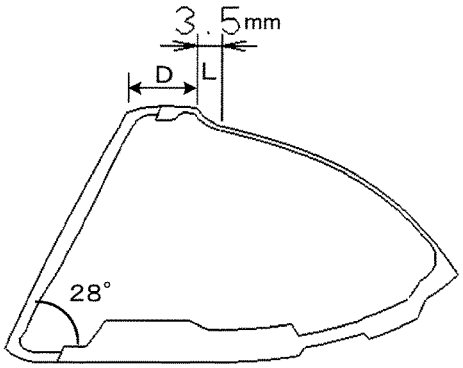

The crown portion 2 will be described with reference to FIG. 5. FIG. 5 is a cross-sectional view taken along the A-A line in FIG. 2; specifically, FIG. 5 is a cross-section along the perpendicular plane that passes through the sweet spot and the center of gravity of the head (the plane perpendicular to the horizontal plane H described above; the same applies below). As shown in this drawing, the crown portion 2 is constituted by a main body portion 21 that is connected to the side portion 4 and a raised portion 22 that is connected to the face portion 1. The raised portion 22 is the band-like region that extends in the toe-heel direction along the face portion 1 and a step 23 is the boundary with the main body portion 21. Specifically, as shown in FIG. 5, the raised portion 22 is formed at a higher position than the main body portion 21 via the step 23 that extends so as to form an incline. Accordingly, the height of the face portion 1 in the up-down direction is higher by the amount of the step 23 between the raised portion 22 and the main body portion 21. Note that the peripheral portion 12 of the face member 20 joined to the raised portion 22 also functions as a part of the raised portion 22.

The raised portion 22 includes a first portion 221 that is joined to the peripheral portion 12 of the face member 20 and a second portion 222 that is integrally connected to the back side of the first portion 221. The first portion 221 is the part that joins to the end surface of the peripheral portion 12 of the face member 20, and has a larger thickness than the peripheral portion 12. On the other hand, the second portion 222 has a smaller thickness than the first portion 221. More specifically, at the outer surface of the crown portion 2, the parts 221 and 222 are connected in a flat manner, but at the inner surface of the crown portion 2, the second portion 222 is thinner than the first portion 221 due to a step formed at the rear end side of the first portion 221. Also, as described above, the step 23 at the rear end of the raised portion 22 is formed at the rear end portion of the second portion 222.

A total width D of the peripheral portion 12 of the face member 20 and the raised portion 22 in the face-back direction is preferably 5 to 20 mm, and more preferably 7 to 15 mm, for example. Of this width, the width of the first portion 221 in the face-back direction is preferably 1 to 10 mm, and more preferably 1 to 5 mm, for example. The width ratio between the first portion 221 and the second portion 222 preferably is roughly 1:1. Also, a height h of the step 23 between the raised portion 22 and the main body portion 21 is preferably 1 to 5 mm, and more preferably 1.5 to 4 mm, for example. Furthermore, the thickness of the first portion 221 of the raised portion 22 is preferably 1 to 3 mm, and more preferably 1.5 to 2.5 mm, for example. Also, the thickness of the second portion 222 of the raised portion 22 is preferably 0.5 to 1.5 mm, and more preferably 0.7 to 1.2 mm, for example. The thickness of the second portion 222 is roughly the same as the thickness of the main body portion 21 of the crown portion 2. Note that these dimensions are substantially the same for all numbers of the golf club set according to the present embodiment.

As described above, the thickness of the first portion 221 of the raised portion 22 is greater than the thickness of the end surface of the peripheral portion 12 of the face member 20, and this point is also the same for the sole portion 3 and the side portion 4. For example, as shown in FIG. 5, at the sole portion 3, the thickness of the end surface at the opening side is thicker than the thickness of the peripheral portion 12 of the face member 20 joined thereto.

4. Difference in Raised Portion for Each Club Number

Next, the difference in the raised portion for each club number will be described. With the utility-type golf clubs that constitute the golf club set according to the present embodiment, in addition to differences in the loft angle for each club number, lengths L of the step between the raised portion and the main body portion (hereinafter, simply "step length L") in the face-back direction are different. The step length L is the length from the rear end edge of the raised portion to the front end edge of the main body portion in the face-back direction. Examples are shown in FIGS. 6A to 6F. In these examples, cross-sections of a utility-type golf club set that includes No. 2 (FIG. 6A), No. 3 (FIG. 6B), No. 4 (FIG. 6C), No. 5 (FIG. 6D), No. 6 (FIG. 6E), and No. 7 (FIG. 6F) clubs are shown, and the loft angles and the step lengths L are shown in the figures. All figures are cross-sections along the perpendicular plane that passes through the sweet spot and the center of gravity of the head.

According to FIGS. 6A to 6F, the step length L shortens in the order of the No. 2, No. 3, No. 4, and No. 5 clubs, and the No. 5, No. 6, and No. 7 clubs have the same step length L. Note that the maximum height of the head, the total width D of the peripheral portion and the raised portion and the height of the raised portion are substantially the same for all club numbers. Also, the step length L is the length along the perpendicular plane that passes through the sweet spot and the center of gravity of the head described above, and is the distance between both end portions in the face-back direction described below. Specifically, the end portion on the face side is the ridge line on the back side of the raised portion 22, the end portion on the back side, in the cross-section of the crown portion 2, is defined by the inflection point between the downward curve and the upward curve, and the distance between these end portions is deemed to be the length L of the raised portion 22.

5. Manufacturing Method

Figure 7:
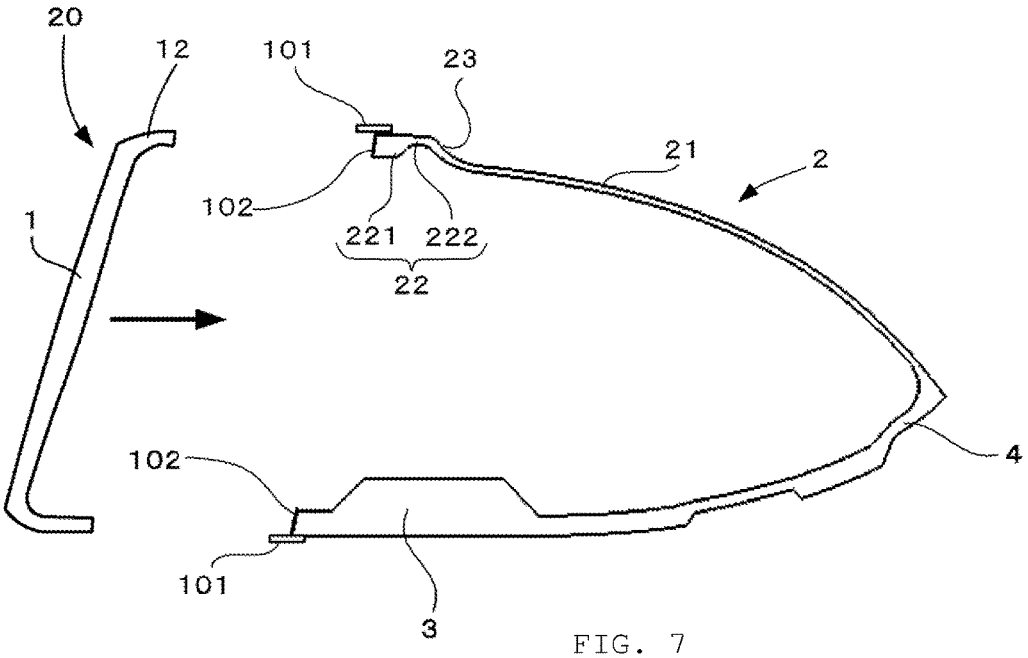
FIG. 7 is a cross-sectional view illustrating assembly of the golf club head shown in FIG. 1.
Figure 8:
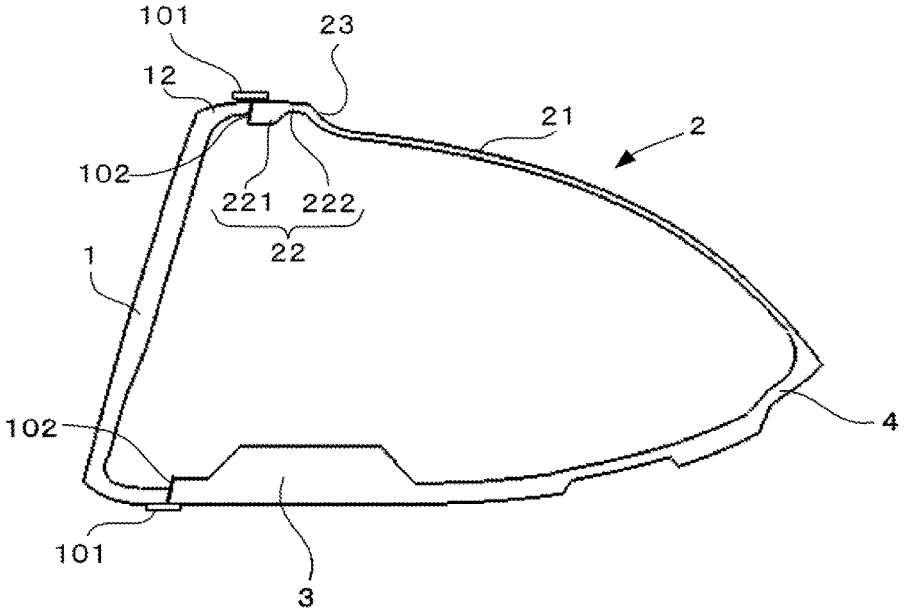
FIG. 8 is a cross-sectional view illustrating assembly of the golf club head shown in FIG. 1.

The golf club heads configured as described above can all be manufactured using various methods, and can be manufactured in the following manner, for example. First, the head body 10 can be manufactured by casting using a known method such as lost wax precision casting, for example. On the other hand, the face member 20 can be manufactured by press working. Then, the head body 10 and the face member 20 are joined by welding as described below, for example. While the head body 10 can be manufactured with a method such as lost wax precision casting, as described above, the structure of the head body member material prior to welding is slightly different to that of the completed head body 10. Specifically, as shown in FIG. 7, on the outer surface of the peripheral edge of the opening in the head body 10, that is, on the outer surface of the crown portion 2, the sole portion 3, and the side portion 4, a protruding portion 101 is provided so as to project toward the face portion side. Specifically, the protruding portion 101 is formed in the shape of a ring along the peripheral edge of the opening. Thus, prior to welding, when joining the end surface of the peripheral portion 12 of the face member 20 and the end surface of the opening, the outer surface of the end portion of the peripheral portion 12 is covered by the ring-shaped protruding portion 101, as shown in FIG. 8. At this time, the thickness of the end surface of the peripheral portion 12 of the face member 20 is less than the thickness of the end surface of the opening, and therefore a step 102 is formed between the two end surfaces.

Figure 9:
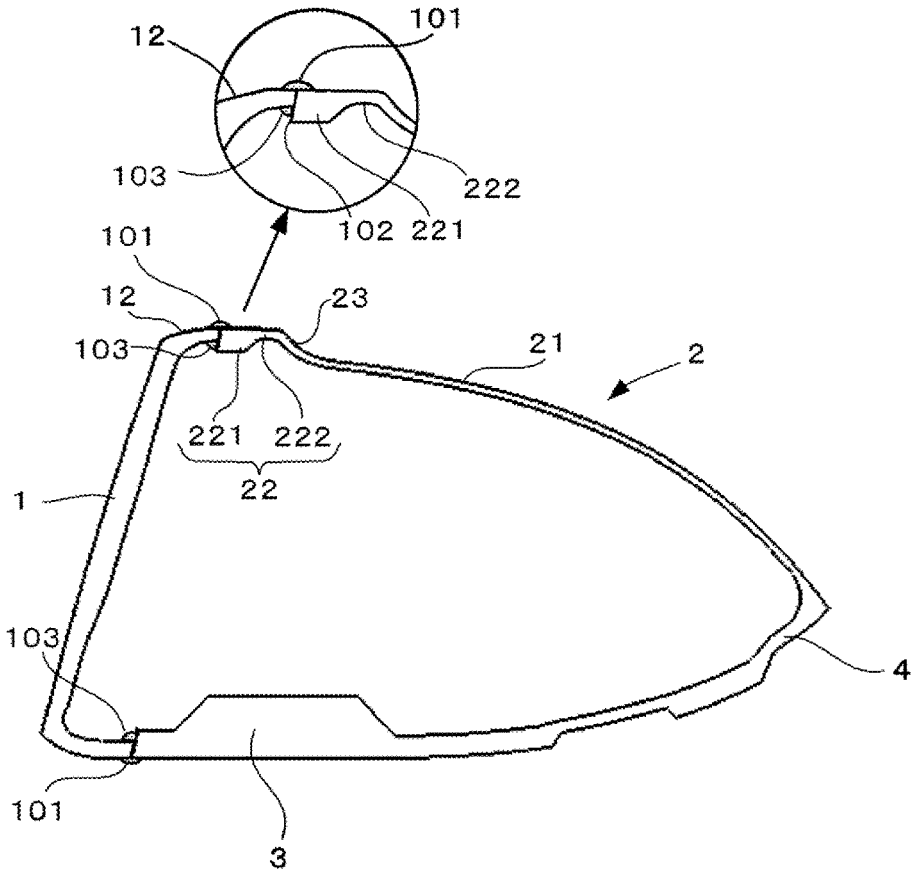
FIG. 9 is a cross-sectional view illustrating assembly of the golf club head shown in FIG. 1.
Figure 10:
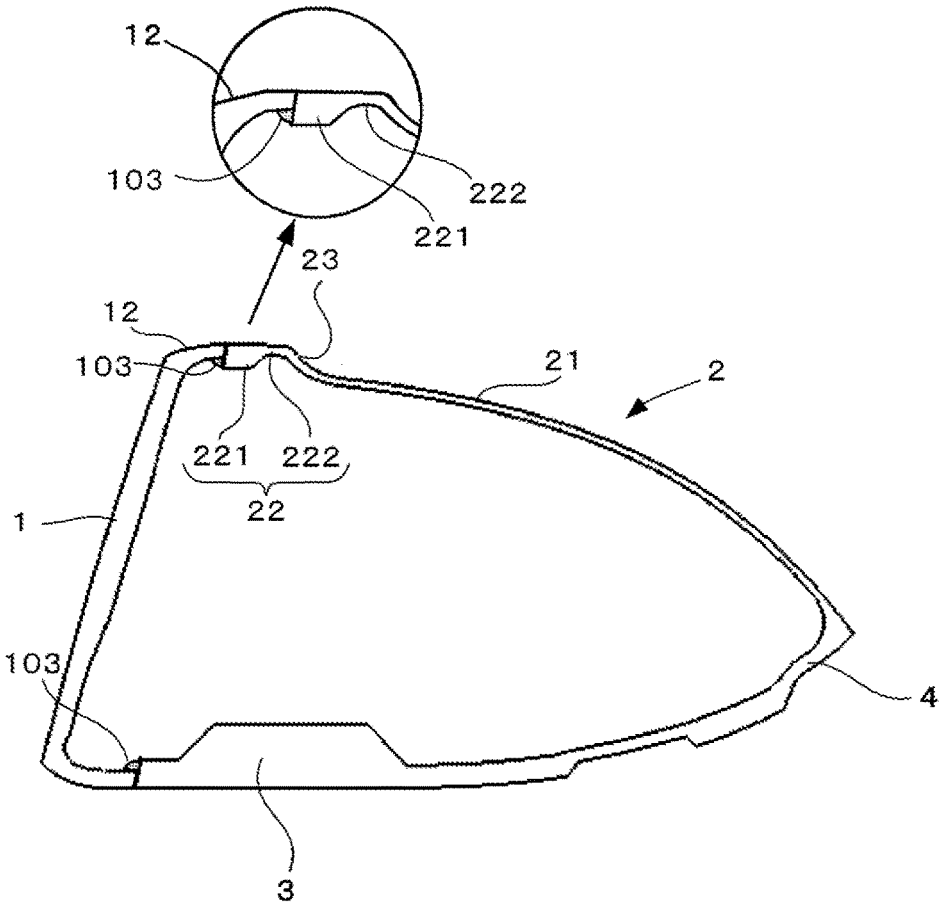
FIG. 10 is a cross-sectional view illustrating assembly of the golf club head shown in FIG. 1.

Then, welding is performed on the protruding portion 101 along the boundary between the end surface of the peripheral portion 12 of the face member 20 and the end surface of the opening in the head body 10. Accordingly, as shown in FIG. 9, the two end surfaces are welded together via the protruding portion 101. At this time, the melted end surfaces run along the step 102, and thus a weld bead 103 is also formed along the step 102. When the welding is thus completed, the melted protruding portion 101 is shaved down so that the joined portion between the peripheral portion 12 of the face member 20 and the opening of the head body 10 is flat, as shown in FIG. 10. Thereafter, painting and the like is performed, and the golf club head is completed.

6. Features

According to the present embodiment, as described above, the length of the step of a lower numbered golf club is longer than the length of the step of a higher numbered golf club, and thus the following effect can be obtained. For example, when a lower numbered golf club is used at address, the head is generally placed more forward. Accordingly, the step of the raised portion is easier to see, and even if the height and the length of the step is the same as that of a higher numbered golf club, there is a tendency for the step to stand out and appear higher than in actuality. On the other hand, when a higher numbered golf club is used, the head is generally placed closer to in the front of the golfer when taking the address position. Accordingly, the step of the raised portion is harder to see and the height of the raised portion is less visually recognizable. Thus, the perception of the step of the raised portion for a lower numbered golf club and a higher numbered golf club differs, and when different numbered clubs are used one after the other, a sense of something not being right is felt, making it difficult to take the address position naturally.

In contrast, with the golf club set according to the present embodiment, the length of the step is longer in lower numbered golf clubs and the incline of the step is made to be gentle as described above. Therefore, the height of the step tends not to stand out, and the step appearing higher than in actuality can be suppressed. Accordingly, even if different numbered clubs are used, noticing the difference in the height of the steps is suppressed and the address position can be naturally taken without feeling that something is not right at address.

Furthermore, the following effect can be obtained. The loft angle is larger for higher numbered golf club heads, and therefore the height of the sweet spot tends to be higher in higher numbered golf clubs compared to lower numbered golf clubs. In contrast, in the present embodiment, the length of the step of the higher numbered golf clubs is shorter, and therefore the area of the main body portion 21 with a lower height can be widened and the center of gravity can be lowered. As a result, the height of the sweet spot is lowered, and the center of gravity of the head can be lowered even though the loft angle is large, thus making it easier to hit the golf ball higher.

Also, the following results can also be obtained with each of the golf club heads.

(1) The crown portion 2 includes the main body portion 21 connected to the side portion 4, and the raised portion 22 that extends in the toe-heel direction along the boundary with the face portion 1 and is raised by forming the step 23 from the main body portion 21. Accordingly, in the crown portion 2, the raised portion 22 is formed higher than the main body portion 21 via the step 23, and therefore the height of the face portion 1 can be increased by the height of the raised portion 22. Thus, the restitution performance of the face portion 1 can be improved. Also, in the crown portion 2, only the raised portion 22 is formed higher and the main body portion 21 that occupies the larger portion of the crown portion 2 is formed at a lower position than the raised portion 22, and therefore the center of gravity of the head can be lowered.

(2) Because the face member 20 is formed in a cup shape that includes a plate-shaped face portion 10 and the peripheral portion 12 connected to the peripheral edge thereof, the peripheral portion 12 also contributes to the restitution, in addition to the restitution of the face portion 1, and therefore the restitution performance can be improved. Also, when the cup-shaped face member 20 is used, the position of the weld bead is higher compared to a golf club head of the type where the plate-shaped face portion fits into the opening, and thus there is a possibility that the position of the center of gravity will be higher. However, the head according to the present embodiment is provided with the raised portion 22 described above, and the height of the main body portion 21 excluding the raised portion 22 is set lower, and thus the center of gravity of the head can be lowered overall.

(3) The thickness of the end surface of the opening in the head body 10 is greater than the thickness of the end surface of the peripheral portion 12 of the face member 20, and therefore the step 102 occurs when the two end surfaces are joined. Thus, the weld bead 103 formed when welding is formed along the step 102, and therefore the weld bead 103 is accurately formed along the boundary between the two end surfaces. Thus, variation in welding strength does not occur, and a high joint strength can be realized. Also, because the thickness of the end surface of the opening in the head body 10 is large, rigidity is increased, and as a result, mechanical strength relative to the striking force from the face portion 1 can be improved.

(4) The protruding portion 101 is formed to project on the face portion side from the outer peripheral surface of the opening in the cast head body material, and thus welding is performed from above the protruding portion 101 during welding. At this time, for example, if welding is performed directly on the boundary between the two end surfaces without a protruding portion having been provided, there is a concern that a depression due to a sink mark will occur. In contrast, if the protruding portion 101 is provided, the depression occurs in the protruding portion 101, and therefore the occurrence of a depression directly on the head body 10 and the peripheral portion 12 of the face member 20 can be prevented.

(5) The raised portion 22 is constituted by the thick first portion 221 and the thin second portion 222, with the thickness of the second portion 222 being small. Therefore, restitution performance can be improved.

7. Variations

Although an embodiment of the present invention has been described above, the present invention is not limited to the foregoing embodiment, and various modifications can be made without departing from the gist of the invention. The following are examples of modifications that can be made.

7.1

In the above embodiment, FIGS. 6A to 6F shows examples of differences in the step in the golf club set, but these are merely examples. In order to obtain the above-described effects, the difference in the step length as described above need only be provided in at least a pair of a lower numbered golf club and a higher numbered golf club in the golf club set. Therefore, the difference in the length of the step may be provided between all club numbers, or alternatively, the difference in the length of the step may be provided in only some of the club numbers. Also, the numerical values of the length of the step are examples, and can be changed depending on the golf club to which the present invention is applied.

7.2

In the aforementioned embodiment, the total width D of the peripheral portion and the raised portion is the same for all club numbers, but can be varied slightly.

7.3

The mode of a golf club according to the embodiment described above is an example, and the remaining configuration is not particularly limited as long as the raised portion 22 such as described above is provided to the crown portion 2. For example, in the golf club described above, the cup-shaped face member 20 is joined to the opening of the head body 10, but the golf club head can be configured by fitting a plate-shaped face portion into the opening of the head body.

7.4

The golf club set is constituted by utility-type golf clubs, but the golf club set may be constituted by fairway wood-type golf clubs or hybrid-type golf clubs. Note that it is desirable that the volume of the head is, for example, at least 120 $cm^3$ and no more than 200 $cm^3$ for a fairway wood. Also, it is desirable that the volume of the head is no more than 460 $cm^3$ for a driver in the case of complying with R&A and USGA rules and regulations.

REFERENCE SIGNS LIST

1 Face portion
2 Crown portion
21 Main body portion
22 Raised portion
23 Step
3 Sole portion
L Step length

The invention claimed is:

1. A golf club set comprising a plurality of numbered golf clubs with different loft angles, wherein the golf clubs each include:

a shaft; and a golf club head, and wherein the golf club head has a hollow structure that includes:

a top crown portion; a face portion with a front portion for hitting a golf ball, a toe portion disposed away from the shaft and a heel portion disposed near to the shaft; and a bottom sole portion, wherein the crown portion includes:

a main body portion that connects to the sole portion; and a raised portion that extends in a toe-heel direction along a boundary with the face portion and rises to form a step from the main body portion, and wherein in at least one pair of a lower numbered golf club and a higher numbered golf club, among the plurality of golf clubs included in the golf club set, a length of the step in a face-back direction opposite to the front portion direction along a perpendicular plane that passes through a sweet spot and a center of gravity of a golf club head is longer in the lower numbered golf club than in the higher numbered golf club, at least one of the golf clubs included in the golf club set is configured by assembling a head body and a face member, the head body is constituted by the crown portion and the sole portion, and has an opening formed therein that is surrounded by the crown portion and the sole portion, the face member is formed in a cup shape having the front portion that has a plate shape and is for hitting a ball and a peripheral portion that extends from a peripheral edge of the face portion in the face-back direction and is joined to an end surface of the opening, and the peripheral portion of the face member is joined to the crown portion and the sole portion at the opening of the head body.

2. The golf club set according to claim 1, wherein the at least one pair of the lower numbered golf club and the higher numbered golf club are adjacently numbered golf clubs.

3. The golf club set according to claim 1, wherein the length of the raised portion in the face-back direction along the perpendicular plane that passes through the sweet spot and the center of gravity of the golf club head is substantially same for the lower numbered golf club and the higher numbered golf club.

4. The golf club set according to claim 1, wherein the raised portion includes a first portion that is joined to a peripheral portion of the face member and a second portion that is integrally connected to a back side of the first portion, the first portion is thicker than the peripheral portion of the face member.

5. The golf club set according to claim 4, wherein the first portion is thicker than the second portion.

6. The golf club set according to claim 5, wherein at an outer surface of the crown portion, the first portion and the second portion are connected in a flat manner, at an inner surface of the crown portion, the second portion forms a step at the back side of the first portion.

7. The golf club set according to claim 4, wherein a length of the first portion in the face-back direction and a length of the second portion in the face-back direction are substantially same.

8. The golf club set according to claim 4, wherein the second portion has a thickness that is substantially the same as the crown main body portion thickness.

9. The golf club set according to claim 1, wherein at the sole portion, a thickness of an end surface at the opening is thicker than a thickness of an peripheral portion of the face member.

10. The golf club set according to claim 4, wherein a height of the raised portion is substantially same for the lower numbered golf club and the higher numbered golf club.

* * * * *